US005454144A

United States Patent [19]

Rupprechter

[11] Patent Number: 5,454,144

[45] Date of Patent: Oct. 3, 1995

[54] FURNITURE HINGE INCLUDING BASE PLATE WITH CLAW MEMBER

[75] Inventor: Helmut Rupprechter, Lauterach, Austria

[73] Assignee: Julius Blum Gesellschaft m.b.H., Höchst, Austria

[21] Appl. No.: 197,326

[22] Filed: Feb. 16, 1994

[30] Foreign Application Priority Data

Feb. 22, 1993 [AT] Austria ..... A324/93

[51] Int. Cl.[6] ..... E05D 5/00

[52] U.S. Cl. ..... 16/382; 16/389

[58] Field of Search ..... 16/235–338, 387, 16/385, 389, 382, 249, 383, 390

[56] References Cited

U.S. PATENT DOCUMENTS

| | | | |
|---|---|---|---|
| 4,091,522 | 5/1978 | Suermann et al. | 16/237 |
| 4,290,167 | 9/1981 | Lautenschlager | 16/249 |
| 4,434,523 | 3/1984 | Grass | 16/247 |
| 4,554,706 | 11/1985 | Rock et al. | 16/237 |
| 4,604,769 | 8/1986 | Rock et al. | 16/238 |
| 5,175,908 | 1/1993 | Domenig | 16/237 |

FOREIGN PATENT DOCUMENTS

| | | | |
|---|---|---|---|
| 380518 | 6/1986 | Austria . | |
| 383179 | 5/1987 | Austria . | |
| 2553462 | 4/1985 | France | 16/382 |

*Primary Examiner*—Lowell A. Larson
*Assistant Examiner*—Donald M. Gurley
*Attorney, Agent, or Firm*—Wenderoth, Lind & Ponack

[57] ABSTRACT

A hinge for an article of furniture having a frame and a door includes a frame-side base plate with a hinge arm and which base plate embraces the frame in the manner of a U by means of two side webs and a central connection web. the hinge arm and a hinge pot are connected to one another by means of an articulated spindle. At least one securing screw secures the base plate to the frame by projecting through the central connection web. At least one claw directed towards the frame is constructed on the side web of the base plate which bears against the inside of the frame.

16 Claims, 2 Drawing Sheets

FURNITURE HINGE INCLUDING BASE PLATE WITH CLAW MEMBER

BACKGROUND OF THE INVENTION

The invention relates to a hinge and base plate for such hinge for items of furniture with a frame and a door or door wing. The base plate has a hinge arm and embraces the frame in the manner of a U by means of two side webs and a central connection web. A door wing-side hingepot or the like is connected to the hinge arm by an articulated spindle or articulated spindles and articulated levers. At least one securing screw secures the base plate to the frame, such securing screw projecting through the central connection web.

In modern furniture construction, so-called door frames are finding increasingly widespread use, these frames as a stable component carrying hinges for doors or door wings, and the actual side walls of the furniture body or carcass being produced from weaker material. This provides the advantage that either the overall cost of the item of furniture can be reduced, since the side walls can be extremely thin, or that higher-quality and thus visually more attractive materials can be chosen for the side walls without the furniture being more expensive by comparison with conventionally produced furniture.

A hinge of this type, in which a base plate embraces a furniture frame in the manner of a U, is known from AT-PS 380 518. AT-PS 383 179 discloses a frame hinge having a base plate embracing a frame in the manner of a U, this base plate having a fixed web on one side and a resilient tongue on the other. The base plate can therefore be placed on various frames the thickness of which varies slightly. The pressure exerted by the resilient tongue is not sufficient to hold the base plate on the frame.

SUMMARY OF THE INVENTION

The object of the invention is to provide an improved hinge of the above type, such that assembly of the base plate on the furniture frame is facilitated.

The assembly of furniture of this type is Generally such that the entire hinge is anchored to the furniture door by means of the hingepot. The furniture carcass is assembled and is transported further, lying on its back, on an assembly line. Then, the doors are suspended on the frames of the furniture carcass.

The object of the invention is achieved in that at least one claw directed towards the frame is constructed on the side web of the base plate which bears against the inside of the frame. As a result, it is possible to initially suspend the door on the frame without using a tool and without threaded attachment. The base plate is clawed to the frame, the open door wing, which tilts outwards slightly, pressing the claw of the base plate into the frame. At a subsequent point on the assembly line, a screw, which definitively fixed the base plate, is now screwed into the frame. Here, an adjustment of the position of the door wing vertically with respect to the item of furniture is still possible. Advantageously, the screw projects through an elongated hole in the base plate.

BRIEF DESCRIPTION OF THE DRAWINGS

An embodiment of the invention will be described in detail below with reference to the attached drawings, wherein.

DETAILED DESCRIPTION OF THE INVENTION

Figure 1:
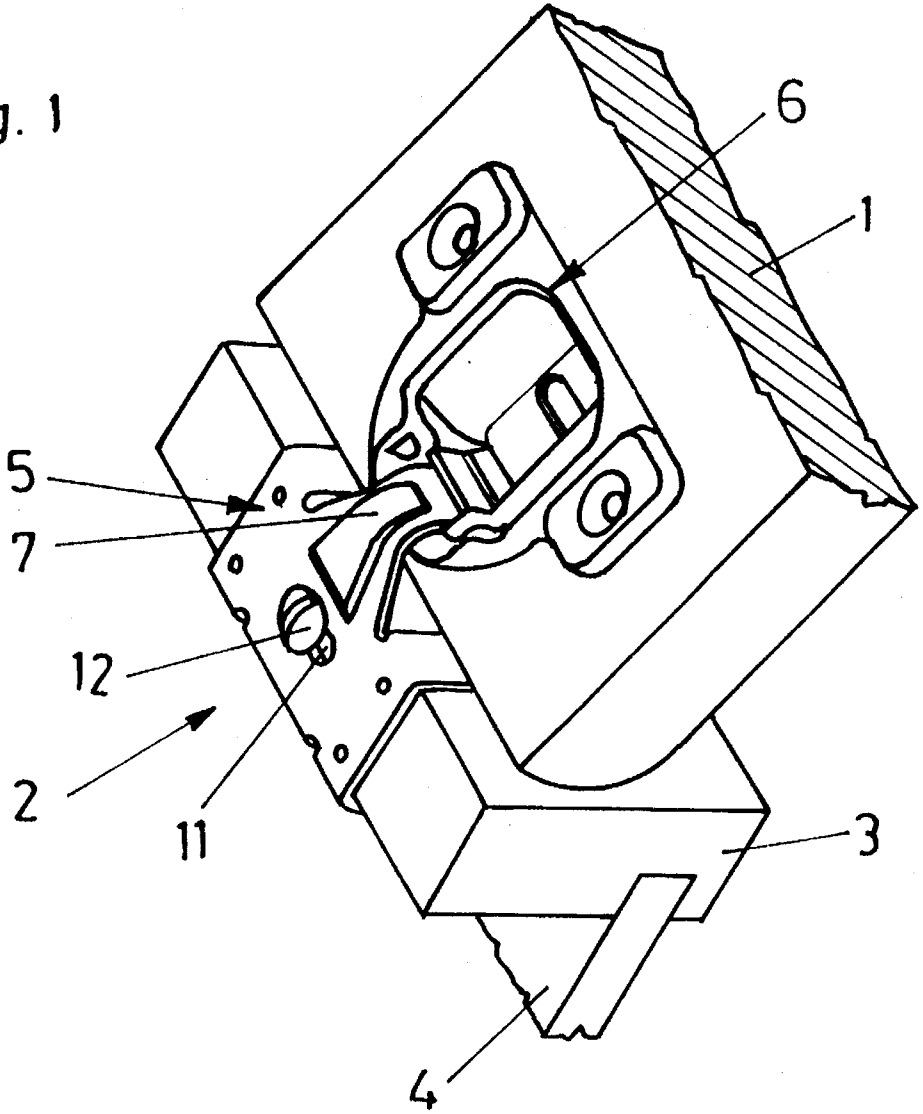
Fig. 1 is a perspective view of a hinge according to the invention, also showing portions of a frame and of a door wing.

In the drawings, a door or door wing 1 is shown in each case in the open position. A hinge 2 connects the door wing 1 to a frame 3 of a furniture body or carcass. Of the furniture carcass only a side wall 4 is shown.

The hinge 2 comprises a base plate 5 and a door wingside hingepot or mounting member 6. Constructed on the base plate 5 is a hinge arm 7 which carries a hinge spindle by means of which the hingepot 6 is secured to the base plate 5. The hingepot 6 is secured to the door wing i in conventional manner.

As can be seen from the drawings, the base plate 5 is constructed in the shape of a U and surrounds the frame 3 by means of two side webs 8, 9. The side webs 8, 9 are connected by means of a central connection web 10 which bears against an end side of the frame 3. Located in the central connection web 10 is an elongated hole 11 through which a securing screw 12 projects. The elongated hole 11 enables the hinge 2 and thus the door wing to be adjusted parallel to frame 3, i.e. vertically.

Figure 2:
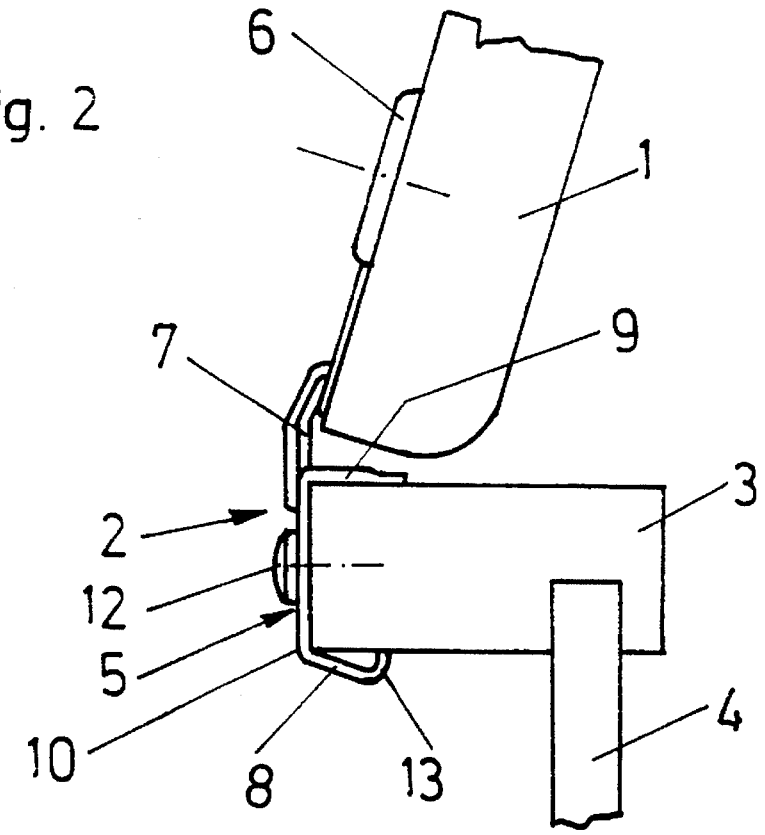
FIG. 2 is a side view of a hinge assembled to a furniture carcass.
Figure 3:
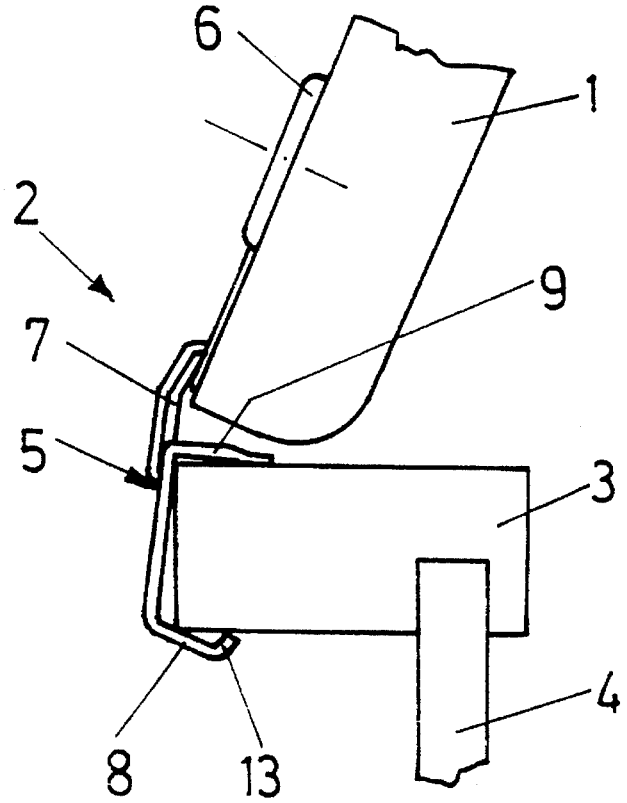
FIG. 3 is a side view of the hinge with a base plate which is merely suspended on a frame.

As can be seen from FIG. 2, a claw 13 is constructed at the free end of the side web 8 and bears against the inside of the frame 3. Claw 13 is inclined from web 8 generally toward web 9. The claw 13 points towards the frame 3. In order to anchor the door wing 1, the base plate 5, as shown in FIG. 3, is suspended on the frame 3. During such time, the weight of the door wing 1 presses the claw 13 into the inside of the frame 3. The outer side web 9 of the base plate 5 here serves as a supporting web.

The hinge arm 7 is punched out of the outer side web 9 and projects approximately at a right angle from the outer side web 9, as a result of which a lever action is achieved and the claw 13 is pressed further into the frame 3. As has already been mentioned, suspending the door wing 1 on the frame 3 by means of the base plates 5 is all that is required to anchor the door wing 1 on the furniture carcass. At the next point of the projection line, a securing screw 12 is screwed into the frame 3 and at the same time pressed the base plate 5 into the position shown in FIG. 2.

What is claimed:

1. A hinge for mounting a door on a door frame, said hinge comprising:

a base plate having a generally U-shaped configuration to embrace the frame and defined by first and second side webs to confront outer and inner surfaces, respectively, of the frame and a central connection web joining said first and second side webs;

a hinge arm extending from said base plate and supporting a mounting member to be connected to the door; and a claw member integral with said second side web and extending therefrom in a direction inclined relative thereto and toward said first side web, such that when said base plate is mounted on the frame said claw member will bear against the inner surface of the frame.

2. A hinge as claimed in claim 1, further comprising at least one articulated spindle or lever connecting said mounting member to said hinge arm.

3. A hinge as claimed in claim 1, further comprising a fastener extending through an opening in said central connection web to rigidly connect said base plate to the frame.

4. A hinge as claimed in claim 3, wherein said opening is elongated.

5. A hinge as claimed in claim 1, wherein said first side web extends in a direction to be flush with the outer surface of the frame.

6. A hinge as claimed in claim 5, wherein said first side web extends substantially at a right angle to said central connection web.

7. A hinge as claimed in claim 5, wherein said second side web extends in a direction to be inclined relative to the inner surface of the frame.

8. A hinge as claimed in claim 7, wherein said second side web extends generally in a plane that is inclined to a general plane of said first side web.

9. A hinge as claimed in claim 8, wherein said planes are inclined at an acute angle.

10. A hinge as claimed in claim 1, wherein said claw member is spaced from said central connection web.

11. A hinge as claimed in claim 10, wherein said claw member is located at a free edge of said second side web remote from said central connection web.

12. A hinge as claimed in claim 1, wherein said claw member is elongated in a direction parallel to directions of elongation of said first and second side webs.

13. A hinge as claimed in claim 1, wherein said hinge arm is formed integrally as a one piece element with said base plate.

14. A hinge as claimed in claim 13, wherein said hinge arm is punched from material of said first side web.

15. A hinge as claimed in claim 13, wherein said hinge arm is substantially coplanar with said central connection web.

16. A hinge as claimed in claim 13, wherein said hinge arm extends at an angle of approximately 90° relative to said central connection web.

* * * * *